United States Patent [19]

Berwick et al.

[11] 4,023,061

[45] May 10, 1977

[54] DUAL MODE GRIDDED GUN

[75] Inventors: Albert Edward Berwick, San Jose; George Valentine Miram, Atherton, both of Calif.

[73] Assignee: Varian Associates, Palo Alto, Calif.

[22] Filed: Jan. 19, 1976

[21] Appl. No.: 649,944

[52] U.S. Cl. ..... 313/349; 313/348; 315/3.5; 315/3.6

[51] Int. Cl.[2] ..... H01J 1/46; H01J 1/52; H01J 17/04; H01J 17/12

[58] Field of Search ..... 315/3.5, 3.6, 5.35; 313/348, 338, 349

[56] References Cited

UNITED STATES PATENTS

| | | | |
|---|---|---|---|
| 2,955,227 | 10/1960 | Nergaard | 315/3.6 |
| 3,558,967 | 1/1971 | Miriam | 313/338 |
| 3,818,260 | 6/1974 | Elfe, Jr. et al. | 315/3.5 |
| 3,859,552 | 1/1975 | Hechtel | 315/3.6 |
| 3,934,168 | 1/1976 | Hardman et al. | 313/348 |

*Primary Examiner*—Saxfield Chatmon, Jr.
*Attorney, Agent, or Firm*—Stanley Z. Cole; Robert K. Stoddard; Richard B. Nelson

[57] ABSTRACT

Travelling wave tubes designed to operate interchangeably at low power cw and high pulsed power have grids to gate the pulses and to switch the peak beam current between two values. To preserve optimum beam-focus conditions, the beam diameter should be simultaneously switched. A grid covering the central region of a concave cathode draws the low-current, small beam for cw operation or the central part of a large pulsed beam. A second grid controls added pulsed emission from the surrounding annular region of te cathode. To provide the proper ratio of beam sizes and uniform cathode loading, the cathode has radially varying radius of curvature. A hyperboloid of revolution is a good shape.

11 Claims, 8 Drawing Figures

SPHERICAL CATHODE AND GRID GUN

FIG.5
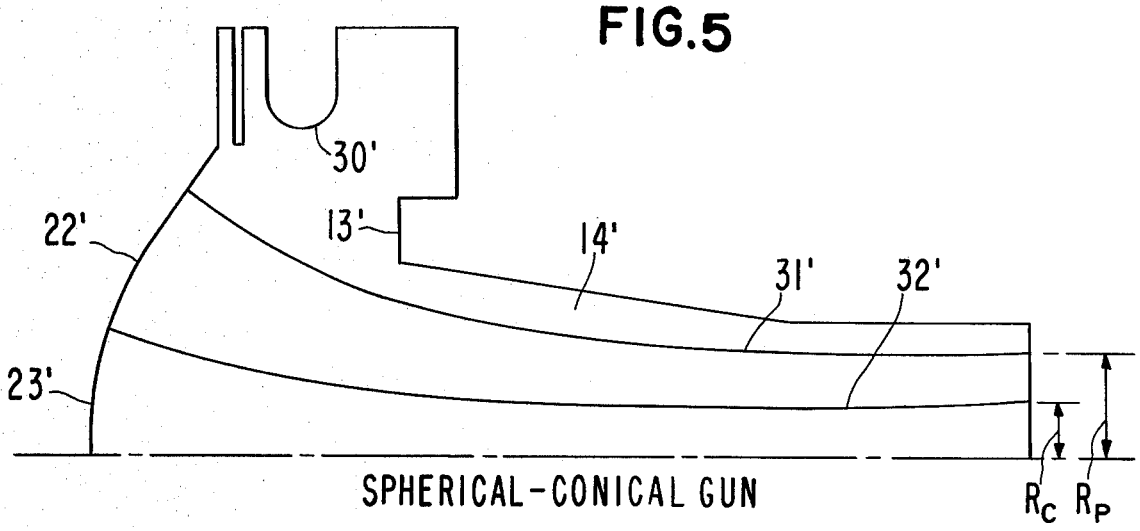
FIG.6
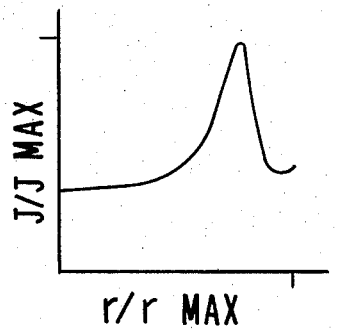
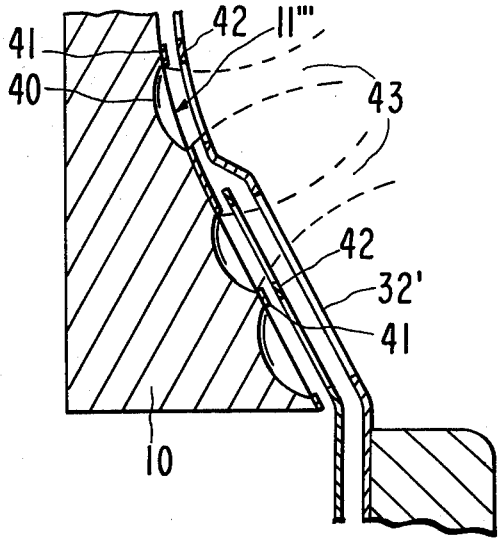
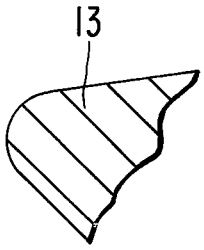
FIG.8
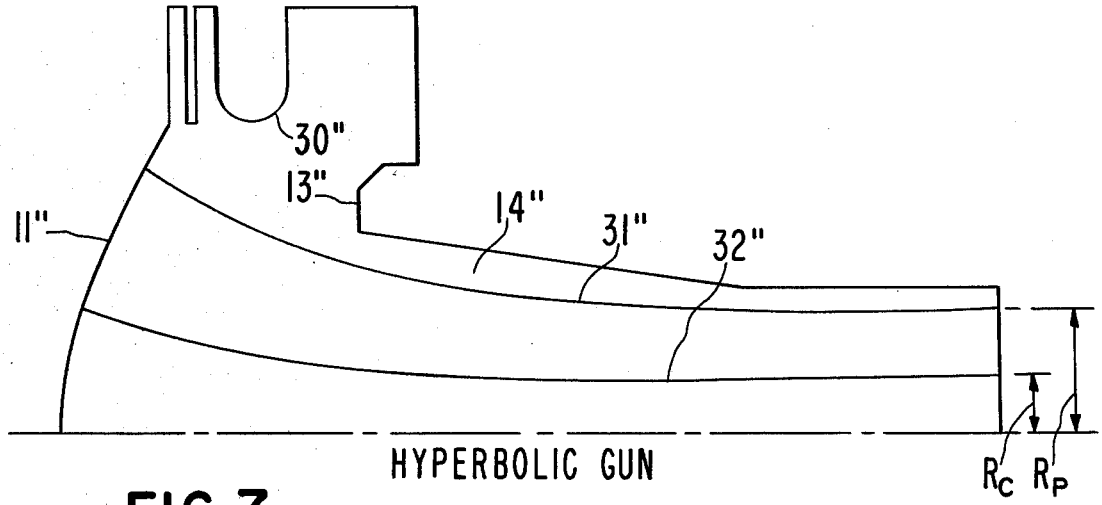
FIG.7

DUAL MODE GRIDDED GUN

FIELD OF THE INVENTION

Traveling wave tubes (TWTs) used in electronic countermeasures (ECM) are sometimes operated in two interchangeable modes: a cw mode suitable for generating noise or similar interference signals, and a pulsed mode with much higher peak power for more sophisticated deception and jamming techniques. The TWT beam voltage must be kept near the synchronous value where the beam velocity approximates the circuit wave velocity. Therefore, the change in peak power must be accomplished by switching the peak beam current. Control grids perform the switching and also gate the pulsed beam.

PRIOR ART

U.S. Pat. No. 3,903,450 issued Sept. 2, 1975 to Ronald A. Forbess and James A. Noland, describes a gun with two overlaying grids. One covers the entire cathode surface to modulate the currents in both modes. The other has an annular mesh area with a large central aperture to gate off current from the outside of the cathode to form a smaller cw beam. The cathode shape is described only as "concave". Examination of the Figures suggests only a spherical surface, and there is no indication in the specification that any other shape would have merit. The spherical-cathode gun is almost universally used in linear-beam tubes and is fully described in "Theory and Design of Electron Beams" by J. R. Pierce, D. Van Nostrand Company, Inc. 1954. The deficiencies of this prior-art gun will be described hereafter.

Non-spherical gridless guns have been proposed in the prior art. The so-called "Heil gun" was designed to reduce the difficulties encountered in achieving the combination of high perveance such as $3 \times 10^{-6}$ amps/volt$^{3/2}$ with a high convergence ratio from the cathode to the final beam diameter. As pointed out by Pierce, this combination in a gridless gun entails difficulties because the electric field at the center of the cathode is weak due to the required large hole in the accelerating anode. This results in the actual anode electrode being farther from the center of the cathode than from its periphery. Thus the electric field and resultant current density are low at the center. To alleviate this trouble the "Heil gun" used an oblate spheroidal cathode to bring the center closer to the anode. This problem, however, does not arise in grid-controlled guns because the current density is controlled by the uniform grid-cathode spacing. The "Heil gun" is now obsolete.

Another non-spherical gridless gun was proposed by Brewer (U.S. Pat. No. 3,139,552) to solve a different problem. With moderate values of perveance such as $1.0 \times 10^{-6}$ amps/volt$^{3/2}$ Brewer found that a more uniform beam could be produced from a cathode profile whose curvature decreased with distance from the axis. This scheme would however aggravate the reduction of current density at the cathode center for a given perveance and convergence.

SUMMARY OF THE INVENTION

The objective of the invention is to provide a dual-mode electron gun for a linear beam tube from which either a small beam of lower perveance or a large beam of higher perveance can be drawn, both beams being laminar and of sizes and current densities such that they can be kept properly focused with the same beam focusing means.

Another objective is the same as the first objective wherein each beam is of substantially uniform current density.

Another objective is the same as the first objective wherein the focusing means is a periodic magnetic field means.

The above objectives are realized by shaping the cathode as a figure of revolution whose radius of curvature in a plane containing the axis increases with distance from the axis. A hyperboloid of revolution has been found particularly advantageous. By following the teachings of the invention, a gun can be designed in which the high-perveance, large beam and the low-perveance small beam are laminar and of sizes such that both are properly focused by the same periodic magnet stack.

BRIEF DESCRIPTION OF THE DRAWINGS

FIG. 5 is a plot of calculated electron trajectories in the gun of FIG. 3.

FIG. 6 is a plot of current density in the beam from the gun of FIG. 3.

FIG. 7 is a plot of calculated electron trajectories in a different embodiment of the invention.

FIG. 8 is a partial axial sectional view of a modified gun with dimpled cathode.

DETAILED DESCRIPTION OF THE INVENTION

Figure 1:
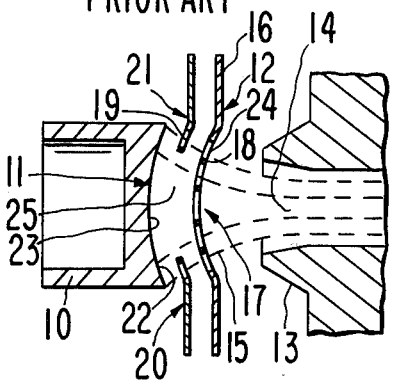
FIG. 1 PRIOR ART
FIG. 1 is a schematic axial section of a prior art gun with spherical electrodes.

Dual-mode microwave tubes such as TWTs are used in ECM transmitters. Such systems often have a cw mode in which a noise-modulated continuous wave is radiated to jam enemy electronic systems. In another mode, the ECM transmitter is intermittently pulsed like a radar transmitter. It is desirable to utilize the full average power of the transmitter in either mode, so the peak power in the pulsed mode must be much higher than in the cw mode. To conserve size and cost of the system, the same TWT is often used for both modes.

Operating requirements for a dual-mode TWT are described in the article "Will The Real Dual-Mode TWT Please Pulse On" by A. W. Scott, Microwaves, Oct. 1972, pp. 58–63 and also in "Dual-Mode TWTs: the Nitty-Gritty" by J. J. Hamilton, Microwaves, May 1974, pp. 38–43.

In a TWT the electron beam velocity must be substantially equal to the circuit wave velocity. To change the peak power by an order of magnitude by switching the beam voltage is thus not possible. The only feasible way is to change the peaK beam current between a low and a high value.

One way to switch the current is by changing the voltage applied to a control grid spaced closely in front of the cathode. However, the convergent focusing of the beam must be designed to produce a laminar, uniform beam of proper diameter with the grid at a more positive potential to draw high current for the pulsed mode. If the grid is then run at a more negative potential to draw low current for the cw mode, the electrostatic space-charge forces between electrons are reduced so that the beam converges too much and the electron trajectories cross over each other. The resultant beam will be non-laminar and will have a highly scalloped outline as it is focused through the TWT interaction structure. Poor rf performance will result.

Another way to change beam current is by the voltage on a "modulating anode" situated between the cathode and the rf circuit. This is described in U.S. Pat. No. 2,842,703 issued July 8, 1958 to Donald H. Priest. The beam size at the position of the modulating anode will be independent of the current drawn. There are, however, serious troubles with use of a modulating anode in a TWT for ECM. The voltage pulse on the modulating anode for the pulsed mode must be comparable to the cathode-to-circuit voltage. To drive the inherent capacity of the modulating anode and the stray capacities of the pulser to this voltage in the submicrosecond times needed would require a large, expensive pulser consuming excessive power. Another, more subtle difficulty is related to the means of focusing the pencil beam through the slow-wave circuit. In ECM tubes, generally used in airborne applications, it is highly desirable to use periodic permanent magnet (PPM) focusing. PPM is effectively a series of magnetic lenses to periodically refocus the beam as it tends to diverge under space-charge repulsion forces. The magnet structure is many times lighter and smaller than a uniform-field magnet. PPM focusing is described in "Power TWTs" by J. F. Gittins, American Elsevier, 1965, pp. 107–114. The dimensions and field strengths of the PPM must be designed for the particular current and voltage of the beam. At a given voltage, a given PPM will properly focus a beam of a certain current density. If the cw density is changed from the pulsed density, as would result from a different voltage on the modulating anode, the beam will defocus.

It is thus recognized by those skilled in the art that a dual-mode TWT must switch the size of the beam in concert with its current to maintain constant current density. This poses a considerable problem in electron optics.

FIG. 1 illustrates a prior attempted solution as disclosed in the above-cited U.S. Pat. No. 3,903,450. This is a conventional Pierce-type electron gun with a thermionic cathode 10 having a concave spherical emissive surface 11. A first control grid 12 as of molybdenum is positioned between cathode 10 and an annular accelerating anode 13 having a central aperture 14 through which the electron beam 15 is focused. Grid 12 has a solid outer support 16 and a central electron-permeable area 17 extending over the entire emissive surface 11 of cathode 10. Permeable area 17 contains conductive web members 18 and apertures 24. A second grid 20 located between cathode 10 and first grid 12 has an annular, electron-permeable area 21 pierced by apertures 19 extending over an outer zone 22 of emissive surface 11 and a large central aperture 25 over an inner part 23 of emitter surface 11. In cw operation second grid 20 is biased negative to cathode 10 so that no emission current is drawn from outer zone 22. First grid 12 is biased positive to cathode 10 to draw a beam from central part 23, limited in diameter by the central aperture 25 in grid 20.

For pulsed operation both grids are dc biased negative to cathode 10 to cut off the beam between pulses. A positive-going pulse is applied to each grid to draw the high-current beam pulse. In the gun of FIG. 1 the positive voltage pulse on first grid 12 must be greater than that on second grid 20 because grid 12 is farther from cathode 10. For a well-focused beam a grid is usually operated in the current-drawing condition at a potential equal to the space potential which would exist at the surface containing the grid if the grid were not there. This potential is higher for the farther-spaced grid 12.

Figure 2:
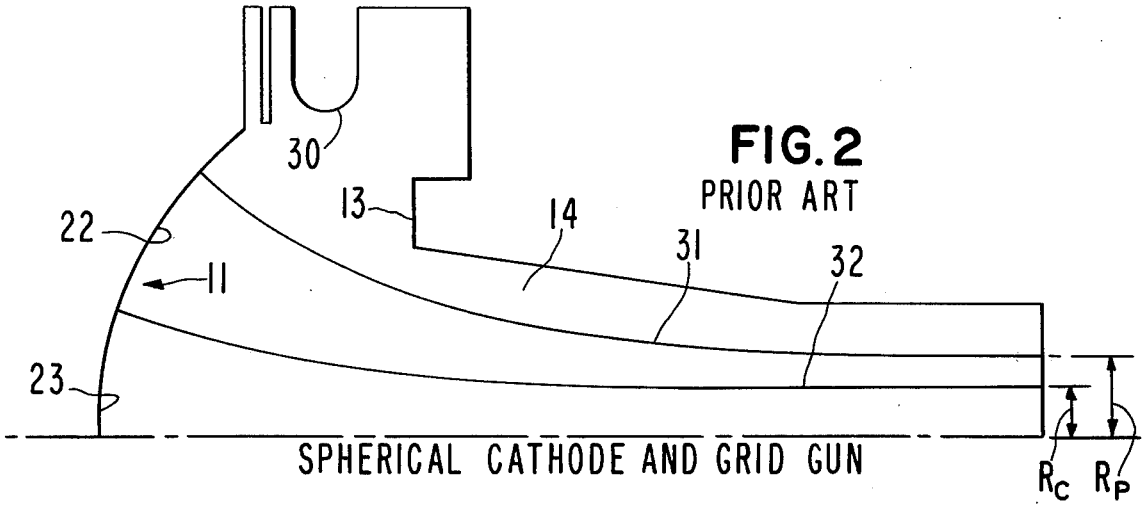
FIG. 2 PRIOR ART
FIG. 2 is a plot of calculated electron trajectories in the gun of FIG. 1.

FIG. 2 is a computer-calculated plot of electron trajectories in a spherical dual-mode gun such as illustrated in FIG. 1. The Figure represents a half-section through the axis of an axially symmetric structure.

Current from cathode emitting surface 11 is focused by a focus electrode 30 at cathode potential, through the aperture 14 in accelerating anode 13. The grids are not shown or included in the calculation because when current is flowing they are presumed to be at local space potential. The electrodes are designed to produce the desired shape of the outer envelope 31 of the large, high-current beam.

For proper magnetic focus of the resulting linear beam its outer envelope radius $R_p$ should be proportional to the square root of the high current $I_p$ in the beam. Calculations showing this requirement are given in the Gittins book referred to above. Thus when the outer zone 22 of the emitter is blocked off by bias on grid 20, the envelope 32 of the small, low-current, cw beam should have a final radius $R_c$ related to the cw current $I_c$ by the relation $$R_p/R_c = I_p^{1/2}/I_c^{1/2}$$

in the gun of FIG. 2 $R_p/R_c$ was 1.5:1 while $I_p^{1/2}$ ½/$I_c^{1/2}$ was 2.23. All other known attempts to design a spherical dual-mode gun with current ratios in the order of 10:1 have resulted in the "small" beam being too large in relation to the "large" beam.

Figure 3:
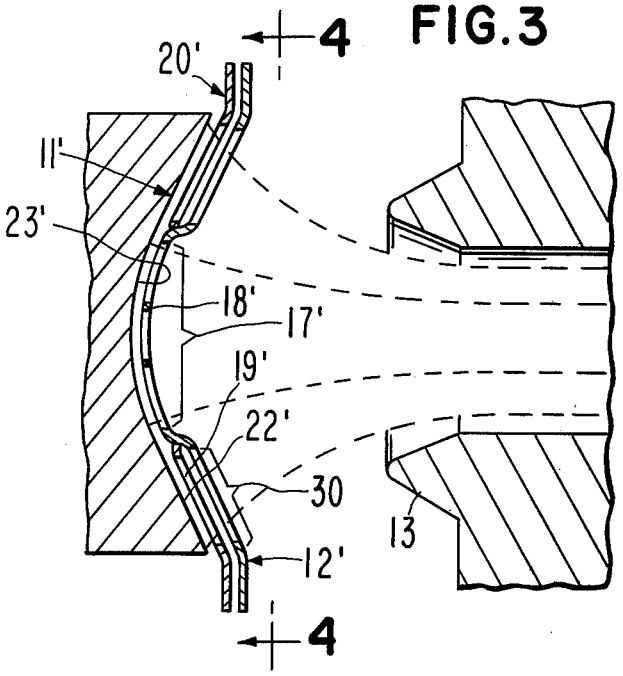
FIG. 3 is a schematic axial section of a gun according to the present invention.
Figure 4:
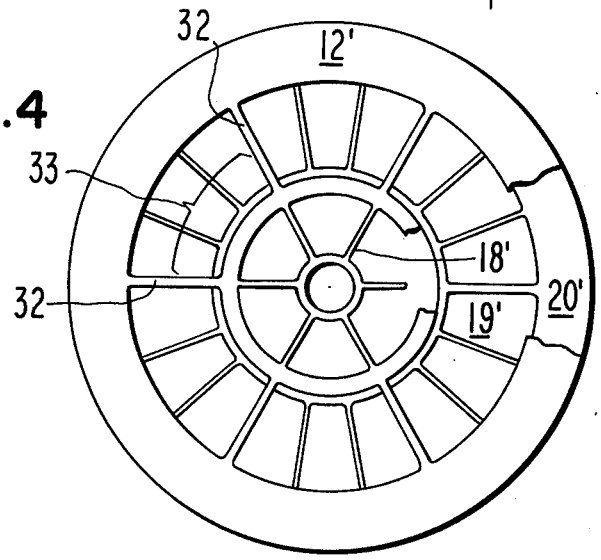
FIG. 4 is an axial view of the grids in the gun of FIG. 3.

FIGS. 3 and 4 show a gun according to the present invention. In this gun the cathode emissive surface 11' is an aspherical figure of revolution whose intersection with a plane containing its axis of revolution is a curve having a smaller radius of curvature in the central zone 23', from which the cw beam is drawn, than in the outer zone 22' from which the outer portion of the pulsed beam is drawn. First grid 12' has a stepped contour such that its central part 17' is at the same close spacing from the cathode surface 11' as is the annular second grid 20'. The pulse-on voltage applied to both grids is thus the same, resulting in a simplified modulator. Also, the closer a grid is to the cathode, the lower the pulse-on voltage need be, resulting in lower modulator power and lower heating of the grid by electron bombardment. As shown in FIG. 4 the outer part 30 of grid 12' has minimal support members 32 to reduce its interaction with the beam. Its apertures 33 in the outer part need not be small because second grid 20' controls the current. Apertures 33 should however be aligned to cover the apertures 19' in grid 20' in order to minimize interception.

Emitter surface 11' (FIG. 3) has a central zone 23' of spherical shape and an outer zone 22' of conical shape, smoothly joined. This composite shape has the virtue of being easily specified and machined.

FIG. 5 shows the resultant electron trajectories from the gun of FIG. 4. The desired ratios of beam radii and currents were achieved. However, a calculation of the current density distribution in the resultant beam gave the profile in FIG. 6. The relative current density $J/J_{max}$ is plotted against relative radial position in the beam $r/r_{max}$. There is a great concentration of current density near the trajectory originating at the junction of the sphere and the cone. Since true laminar focusing requires substantially constant current density, the observed concentration will result in non-laminar flow which is known to be deleterious to TWT gain and efficiency.

FIG. 7 is a trajectory plot for a more sophisticated embodiment of the invention. Here the emissive surface 11'' is a hyperboloid with axis of revolution on the beam axis so that the radius of curvature of its generator increases smoothly and continuously with distance from the axis of revolution. The resulting ratio of beam radii was 2.25:1 and the ratio of square root of beam currents was 2.24:1, quite accurately fulfilling the requirement stated above. Also, the uniformity of beam current density was greatly improved over the spherical-conical gun of FIG. 3.

While applicants have found that a hyperboloidal cathode surface gives excellent results, it will nevertheless be obvious to those skilled in the art that the benefits of the invention do not accrue specifically to this shape. Paraboloidal and prolate elipsoidal shapes have been investigated with slightly poorer results than the hyperboloid, but better than prior-art spherical guns. The inventive improvement may be achieved by many geometries within the scope of the present invention wherein the radius of curvature at a point under the outer annular grid is greater than at a point under its central aperture.

FIG. 8 illustrates a further refinement of the invention wherein the cathode surface has a plurality of concave dimples 40 recessed below the reference surface of revolution 11''' as described in U.S. Pat. No. 3,558,967 issued Jan. 26, 1971. Conductive web members 42 and 32' of the grids are aligned over the non-recessed portions 41 of the cathode surface such that "beamlets" of electrons 43 emitted from dimples 40 are convergently focused to pass between the web members without interception. Non-recessed portions 41 are preferably coated with a non-emissive material to reduce the number of electrons directly projected at conductors 42 and 32'. The "beamlets" 43 of electrons from dimples 40 merge to form the resultant electron beam.

The advantages of the dimpled cathode are a particularly valuable feature of the present invention because the electrons from the annular portion must pass thru two successive grids.

What is claimed is:

1. A grid-controlled electron gun for a linear beam tube comprising:

a cathode emitter having corresponding points of its surface lying on a concave surface of revolution about an axis, a first electron-permeable grid overlaying a central portion of said surface of revolution, a second electron-permeable grid overlaying only an annular portion of said surface of revolution outside said central portion, support means for supporting said grids and said cathode in individually spaced and insulated relation, means for applying separate electric potentials to each of said grids and said cathode, the improvement being the intersection of said surface of revolution with a plane containing said axis having a smaller radius of curvature at a point on said central portion than at a point on said annular portion

2. The apparatus of claim 1 wherein said second grid is immediately adjacent said cathode emitter and wherein a portion of said first grid overlaying said annular portion is spaced from said second grid away from said cathode.

3. The apparatus of claim 2 including a substantially uniform spacing from said surface of revolution to said second grid and to the portion of said first grid overlaying said central portion.

4. The apparatus of claim 2 wherein said portion of said first grid overlaying said annular portion comprises apertures aligned with the apertures in said second grid.

5. The apparatus of claim 2 wherein said portion of said first grid overlaying said annular portion comprises apertures each overlaying a plurality of apertures in said second grid.

6. The apparatus of claim 1 wherein said radius of curvature only increases with distance from said axis.

7. The apparatus of claim 6 wherein said radius increases continuously with said distance.

8. The apparatus of claim 7 wherein said intersection is a hyperbola.

9. The apparatus of claim 1 wherein said cathode emitter comprises areas nearest said grids lying on said surface of revolution and a plurality of concave emissive areas recessed below said surface of revolution, said emissive areas having radii of curvature small compared to the radius of curvature of said surface of revolution.

10. The apparatus of claim 9 wherein conductive elements of said grids substantially overlay said areas nearest said grids, whereby electron current from said concave emissive areas is directed between said conductive elements.

11. The apparatus of claim 10 wherein said areas of said cathode lying on said surface of revolution are coated with relatively non-emissive material whereby electron current intercepted by said grids is substantially reduced.

* * * * *

UNITED STATES PATENT AND TRADEMARK OFFICE

CERTIFICATE OF CORRECTION

PATENT NO. : 4, 023, 061

DATED : May 10, 1977

INVENTOR(S) : Albert Edward Berwick and George Valentine Miram

It is certified that error appears in the above-identified patent and that said Letters Patent are hereby corrected as shown below:

Column 4, line 34, correct the equation to read:

$$I_p^{1/2} / I_c^{1/2}$$

Signed and Sealed this

*Twenty-third* Day of *January 1979*

[SEAL]

*Attest:*

RUTH C. MASON
*Attesting Officer*

DONALD W. BANNER
*Commissioner of Patents and Trademarks*